US006033082A

United States Patent [19]

Lin

[11] Patent Number: 6,033,082

[45] Date of Patent: Mar. 7, 2000

[54] TOOL HAVING AN IMPROVED LIGHT DEVICE

[76] Inventor: Ching Chou Lin, No. 150, Sec. 3, Chung San Road, Wu Zh Hsiang, Taichung Hsien, Taiwan

[21] Appl. No.: 09/143,940

[22] Filed: Aug. 31, 1998

[51] Int. Cl.[7] ..... B25B 23/18

[52] U.S. Cl. ..... 362/120; 362/196; 362/206

[58] Field of Search ..... 362/109, 119, 362/120, 184, 194–196, 206

[56] References Cited

U.S. PATENT DOCUMENTS

| | | | |
|---|---|---|---|
| 1,635,933 | 7/1927 | Genoves | 362/120 |
| 3,603,782 | 9/1971 | Wortmann | 362/120 |
| 4,480,295 | 10/1984 | Shuster | 362/206 |
| 5,158,358 | 10/1992 | Maglica et al. | 362/206 |
| 5,211,468 | 5/1993 | Jeng | 362/120 |
| 5,713,656 | 2/1998 | Lin | 362/120 |
| 5,772,308 | 6/1998 | Lin | 362/119 |

*Primary Examiner*—Alan Cariaso

[57] ABSTRACT

A tool includes a handle having a front chamber for receiving a holder and a barrel and having a rear chamber for receiving a casing to hold one or more batteries. Two conductors are secured to the holder and coupled to one or more light bulbs. The barrel has one or more holes for receiving thae light bulbs and has a drive stem extended outward of the handle. One or more pairs of conductors are further coupled to the batteries for engaging with the conductors of the holder when the casing is engaged into the handle and coupled to a switch for being operated by the switch.

4 Claims, 4 Drawing Sheets

TOOL HAVING AN IMPROVED LIGHT DEVICE

BACKGROUND OF THE INVENTION

1. Field of the Invention

The present invention relates to a tool, and more particularly to a screw driver having a light device.

2. Description of the Prior Art

The closest prior art of which applicant is aware is his prior U.S. Pat. No. 5,713,656 to Lin and comprises a light device engaged in the handle of the tool. The batteries and the light bulbs may not be easily changed individually.

The present invention has arisen to mitigate and/or obviate the afore-described disadvantages of the conventional tools.

SUMMARY OF THE INVENTION

The primary objective of the present invention is to provide a tool having a light device that may be easily assembled and disassembled for changing or for replacing the batteries and the light bulbs.

In accordance with one aspect of the invention, there is provided a tool comprising a handle including a front chamber and a rear chamber and including a front portion and a rear portion, a holder engaged in the front chamber of the handle, a pair of first conductors secured to the holder and each including a contact disposed inward of the rear chamber of the handle, at least one light bulb secured to the conductors, a barrel secured in the front chamber of the handle and including at least one hole formed therein for receiving the light bulb and for allowing a light generated by the light bulb to emit outward of the barrel, the barrel including a drive stem extended forward therefrom and extended outward of the handle, means for securing the holder and the barrel in the handle, a casing engaged in the rear chamber of the handle and including a space formed therein, at least one battery secured in the space of the casing, at least one pair of second conductors secured in the casing and engaged with the battery and each including a limb extended forward of the casing for engaging with the contacts of the first conductors respectively when the casing is engaged into the handle, means for securing the casing in the handle, and a switch including a pair of prongs electrically coupled to the limbs of the second conductors for actuating the light bulb.

The holder includes two channels formed therein for receiving the first conductors.

The holder includes a pair of studs extended forward therefrom, the barrel includes two notches formed therein for receiving the studs of the holder and for preventing the holder from rotating relative to the barrel.

The handle includes at least one slot formed in the front portion of the handle, the barrel includes at least one projection for slidably engaging in the slot of the handle and for preventing the barrel from rotating relative to the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
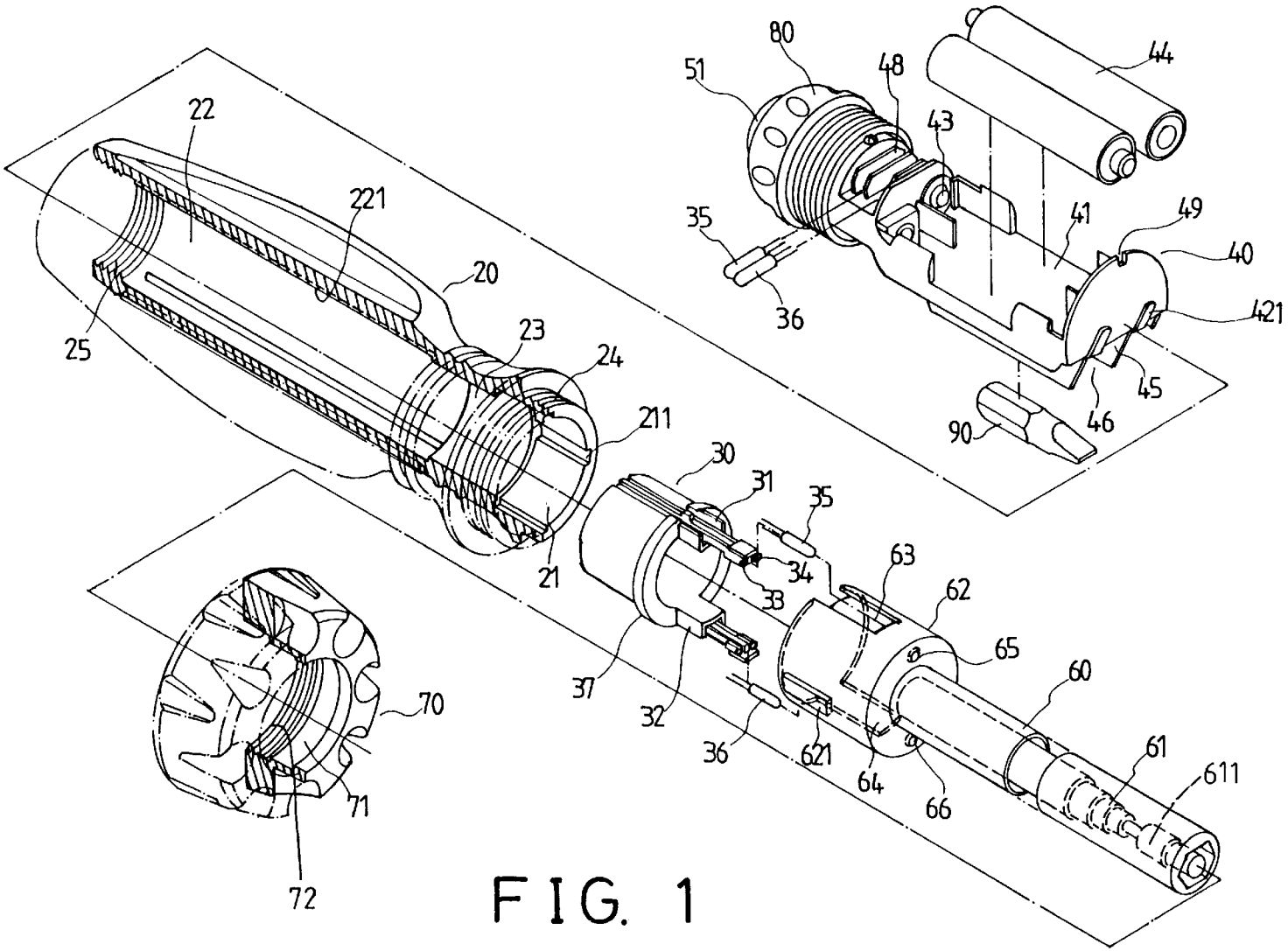
FIG. 1 is an exploded view of a tool in accordance with the present invention.
Figure 2:
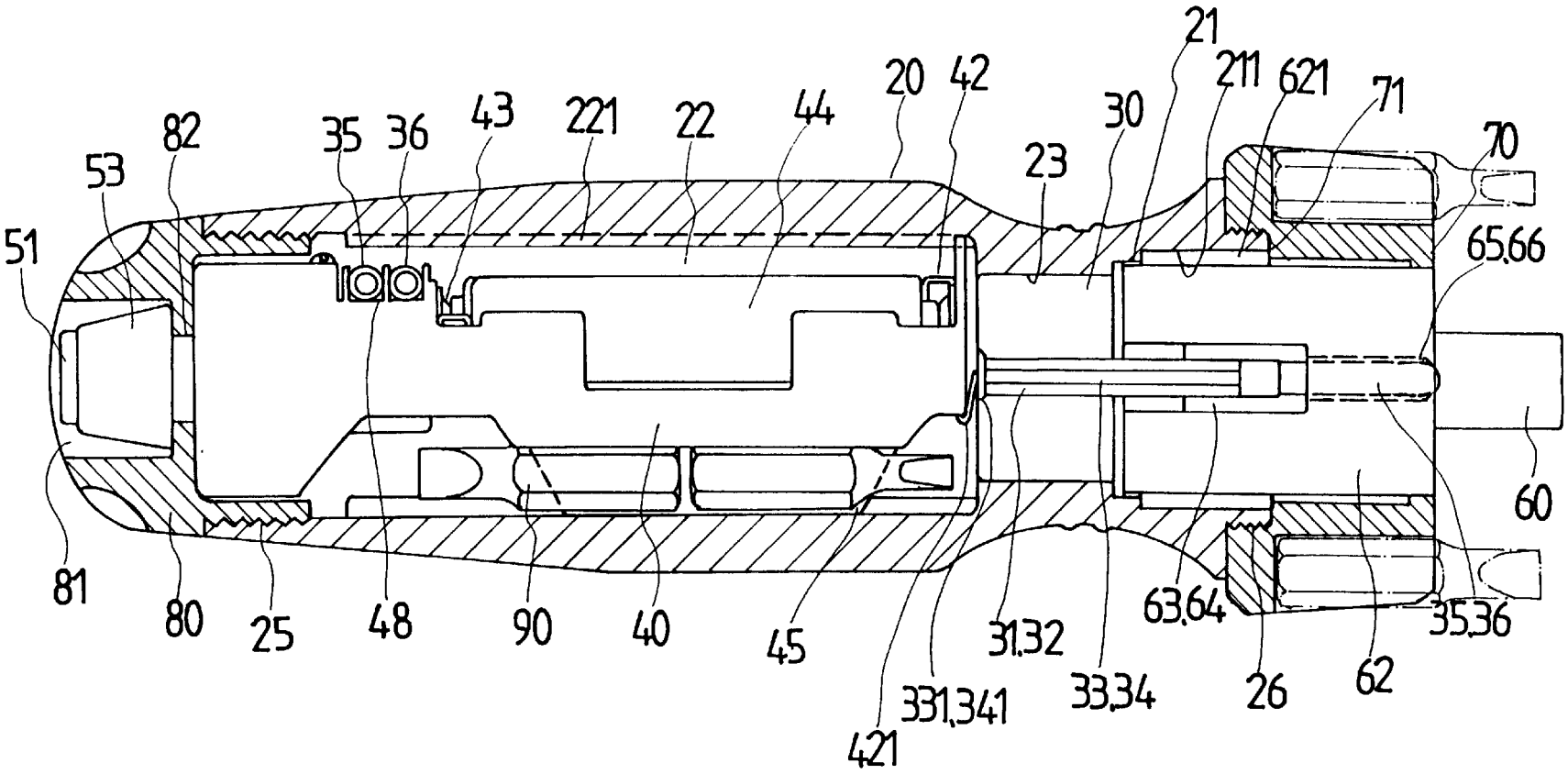
FIG. 2 is a cross sectional view of the handle of the tool.
Figure 3:
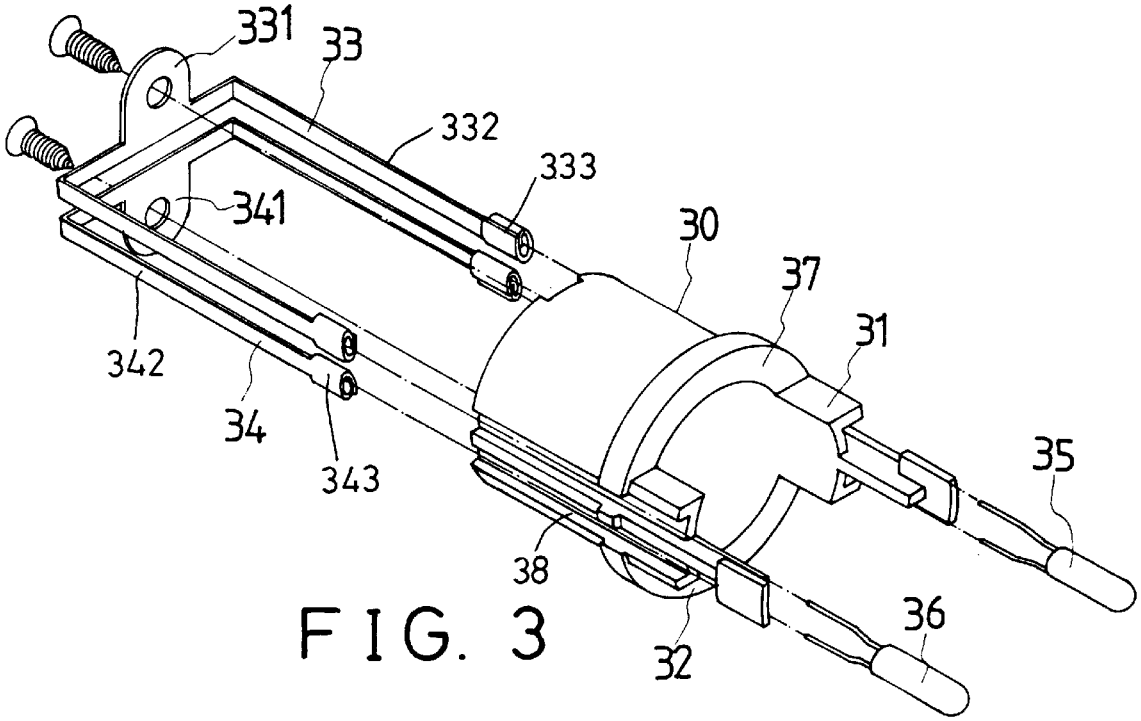
FIG. 3 is an exploded view of a light bulb holder.
Figure 4:
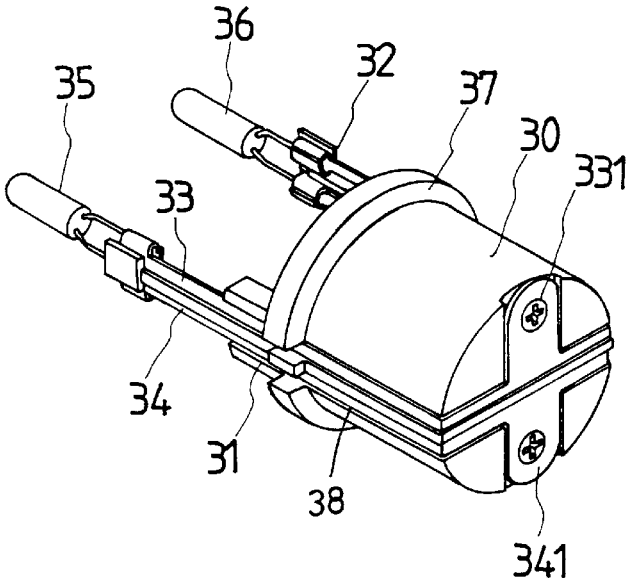
FIG. 4 is a perspective view of the light bulb holder.
Figure 5:
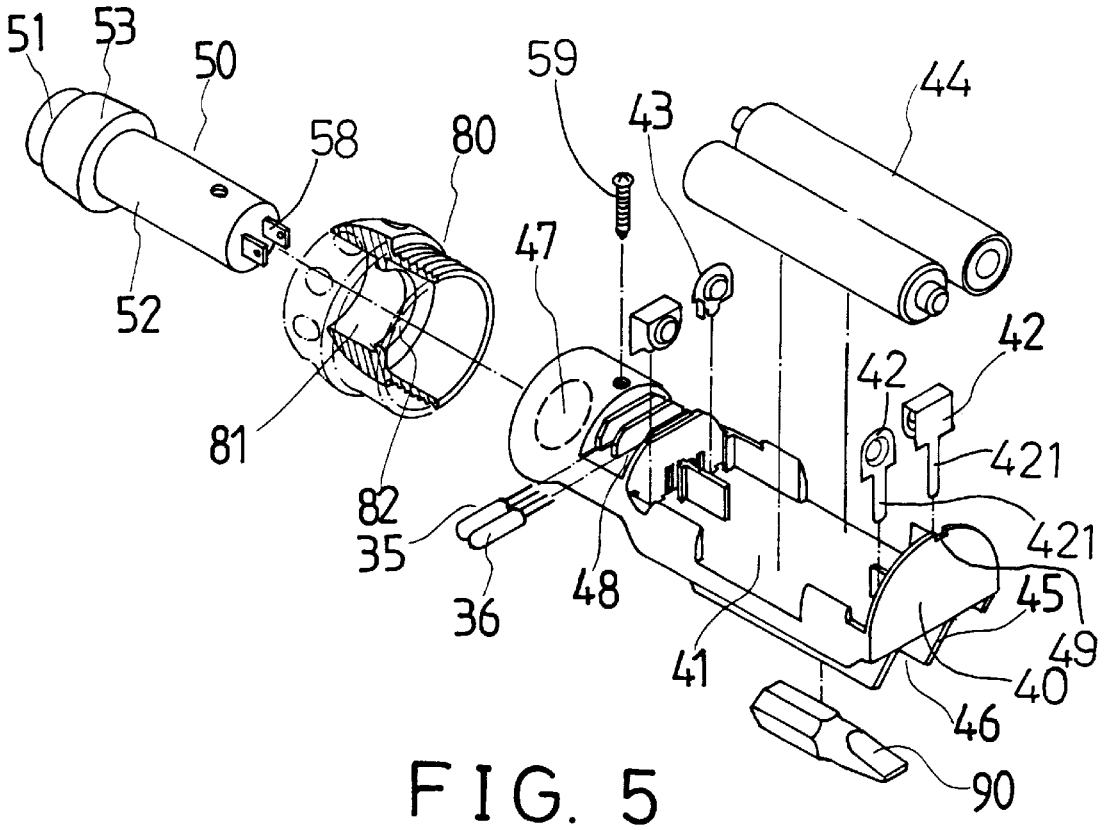
FIG. 5 is an exploded view of a battery holder.
Figure 6:
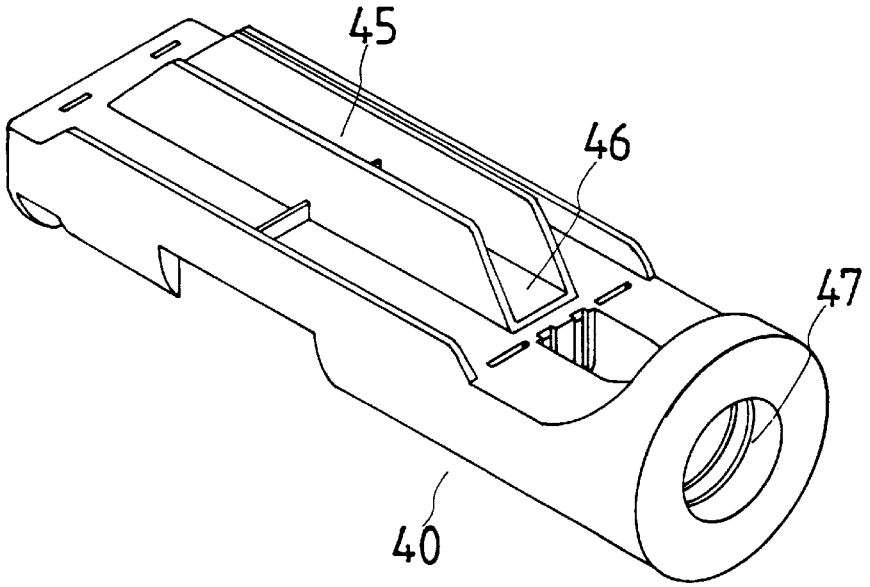
FIG. 6 is a perspective view of the battery holder.

Referring to the drawings, and initially to FIGS. 1 and 2, a tool in accordance with the present invention comprises a handle 20 including a front chamber 21 and a rear chamber 22 and an annular bulge 23 formed between the chambers 21, 22. The handle 20 includes a number of longitudinal ribs or slots 211 formed in the front portion and communicating with the front chamber 21 and includes a number of longitudinal slots or ribs 221 formed in the rear portion and communicating with the rear chamber 22, and includes an outer thread 24 formed in the front portion and an inner thread 25 formed in the rear portion.

As shown in FIGS. 1–4, a holder 30 is received in the front chamber 21 of the handle 20 for supporting light bulbs 35, 36 and includes an annular flange 37 for engaging with the annular bulge 23 and for preventing the holder 30 from moving inward of the rear chamber 22. The holder 30 includes a pair of studs 31, 32 extended forward therefrom and includes two pairs of channels 38 for receiving two legs 332, 342 of two conductors 33, 34 respectively. The conductors 33, 34 each includes a contact 331 , 341 secured in the rear portion of the holder 30 and each includes two sockets 333, 343 formed in the end portions of the legs 332, 342 for receiving the light bulbs 35, 36.

A drive stem 60 includes a telescope extension 61 engaged therein for supporting a magnet 611 (FIG. 1) and for allowing the magnet 611 to be extended outward of the drive stem 60 for attracting fasteners. The drive stem 60 includes a barrel. 62 secured to the rear portion and having two notches 63, 64 for receiving the studs 31 , 32 of the holder 30 and for preventing the holder 30 from rotating relative to the barrel 62 and the drive stem 60. The barrel 62 includes two holes 65, 66 for receiving the light bulbs 35, 36 respectively and for allowing the light generated by the light bulbs 35, 36 to emit outward of the barrel 62. The barrel 62 includes one or more projections 621 slidably engaged in the slots 211 of the handle 20 for preventing the barrel 62 and thus the drive stem 60 from rotating relative to the handle 20. A cover 70 includes an inner thread 72 engaged with the outer thread 24 of the handle 20 and includes an annular flange 71 engaged with the barrel 62 for securing the barrel 62 and the holder 30 to the handle 20.

As shown in FIGS. 1, 2, and 5, 6, a casing 40 is engaged in the rear chamber 22 of the handle 20 and includes a space 41 formed in one side for receiving one or more batteries 44. One or more pairs of conductors 42, 43 are secured in the casing 40 and electrically coupled to the batteries 44. The conductors 42 each includes a limb 421 bent and extended forward of the casing 40 for engaging with the contacts 331, 341 of the conductors 33, 34 (FIGS. 1, 2). The casing 40 includes one or more partitions 45 secured therein for forming two or more depressions 46 and for receiving tool bits 90 or the like, and includes one or more recesses 48 for receiving spare light bulbs 35, 36, and includes an orifice 47 formed in the rear end thereof. A cap 80 is threaded to the inner thread 25 of the handle 20 for securing the casing 40 in the handle 20 and includes an aperture 82 formed in the middle portion and includes an opening 81 formed in the rear end for receiving a head 53 of a switch 50 which includes a body 52 engaged through the aperture 82 of the cap 80 and the orifice 47 of the casing 40. The switch 50 includes two prongs 58 electrically coupled to the conductors 43 respectively and includes a button 51 extended rearward for allowing the user to actuate the switch 50 by depressing the button 51. The switch 50 may be secured to the casing 40 by a fastener device 59 after the switch 50 is engaged through the cap 80.

In operation, the light bulbs 35, 36 thus may be easily actuated by the switch 50 by depressing the button 51. It is to be noted that the holder 30 and the barrel 62 are engaged in the front chamber 21 , and the casing 40 is engaged in the rear chamber 22, such that the light bulbs 35, 36 and the batteries 44 may be replaced individually. It is preferable that the barrel 62 is made of transparent materials. The contacts 331, 341 of the conductors 33, 34 are positioned in place by the holder 30, and the limbs 421 of the conductors 42 may be easily engaged with the contacts 331, 341 when the casing 40 is engaged into the handle 20. Alternatively, the conductors 33, 34 may each include only one leg 332, 342 for supporting a single light bulb 35, 36.

Accordingly, the tool in accordance with the present invention includes a light device that may be easily assembled and disassembled for changing or for replacing the batteries and the light bulbs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a front chamber and a rear chamber and including a front portion and a rear portion, a holder engaged in said front chamber of said handle, a pair of first conductors secured to said holder and each including a contact disposed inward of said rear chamber of said handle, at least one light bulb secured to said conductors, a barrel secured in said front chamber of said handle and including at least one hole formed therein for receiving said at least one light bulb and for allowing a light generated by said at least one light bulb to emit outward of said barrel, said barrel including a drive stem extended forward therefrom and extended outward of said handle, means for securing said holder and said barrel in said handle, a casing engaged in said rear chamber of said handle and including a space formed therein, at least one battery secured in said space of said casing, at least one pair of second conductors secured in said casing and engaged with said at least one battery and each including a limb extended forward of said casing for engaging with said contacts of said first conductors respectively when said casing is engaged into said handle, means for securing said casing in said handle, and a switch including a pair of prongs electrically coupled to said limbs of said second conductors for actuating said at least one light bulb.

2. The tool according to claim 1, wherein said holder includes two channels formed therein for receiving said first conductors.

3. The tool according to claim 1, wherein said holder includes a pair of studs extended forward therefrom, said barrel includes two notches formed therein for receiving said studs of said holder and for preventing said holder from rotating relative to said barrel.

4. The tool according to claim 1, wherein said handle includes at least one slot formed in said front portion of said handle, said barrel includes at least one projection for slidably engaging in said at least one slot of said handle and for preventing said barrel from rotating relative to said handle.

* * * * *